US005586898A

United States Patent [19]

Anderson et al.

[11] Patent Number: 5,586,898

[45] Date of Patent: Dec. 24, 1996

[54] SELF LOCKING MALE AND FEMALE CONNECTORS FOR ELECTRICAL CORDS

[76] Inventors: Dennis R. Anderson; Katherine D. Anderson, both of 1952 Rainbow Ridge, Corona, Calif. 91720

[21] Appl. No.: 344,970

[22] Filed: Nov. 25, 1994

[51] Int. Cl.[6] ..... H01R 13/28

[52] U.S. Cl. ..... 439/287

[58] Field of Search ..... 439/374, 376, 439/342, 287, 369

[56] References Cited

U.S. PATENT DOCUMENTS

| | | | |
|---|---|---|---|
| 4,040,698 | 8/1977 | Ortiz | 439/342 |
| 4,660,913 | 4/1987 | Turner | 439/287 |
| 5,069,634 | 12/1991 | Chiarolanzio | 439/353 |
| 5,129,836 | 7/1992 | Ursich | 439/346 |
| 5,139,438 | 8/1992 | Gaffney | 439/269 |
| 5,194,013 | 3/1993 | Propp | 439/265 |
| 5,219,304 | 6/1993 | Lin | 439/461 |

*Primary Examiner*—Neil Abrams
*Assistant Examiner*—Yong Kim
*Attorney, Agent, or Firm*—David L. Baker; Rhodes & Ascolillo

[57] ABSTRACT

An electrical connector apparatus has a male connector and a female connector. The male connector has a first housing. There is a plurality of first wiring terminals in a first wiring chamber and a plurality of prongs electrically connected to the first wiring terminals. A first T-shaped longitudinal locking foot is attached to a first outer surface of the first housing. A female connector is removably attached to the male connector. The female connector has a second housing. A second wiring chamber is in the second housing. A plurality of second wiring terminals is in the second wiring chamber. There is a plurality of prong receptors electrically connected to the second wiring terminals. These prong receptors are located in the second housing. A first T-shaped longitudinal locking channel is attached to a second outer surface of the second housing to slidingly and removably receive the first T-shaped longitudinal locking foot. A second T-shaped longitudinal locking channel is attached to the third outer surface of the first housing to slidingly and removably receive the second T-shaped longitudinal locking foot on the fourth outer surface of the second housing. A second T-shaped longitudinal locking foot is attached to the second outer surface of the second housing to slidingly and removably receive the first T-shaped longitudinal locking channel.

2 Claims, 3 Drawing Sheets

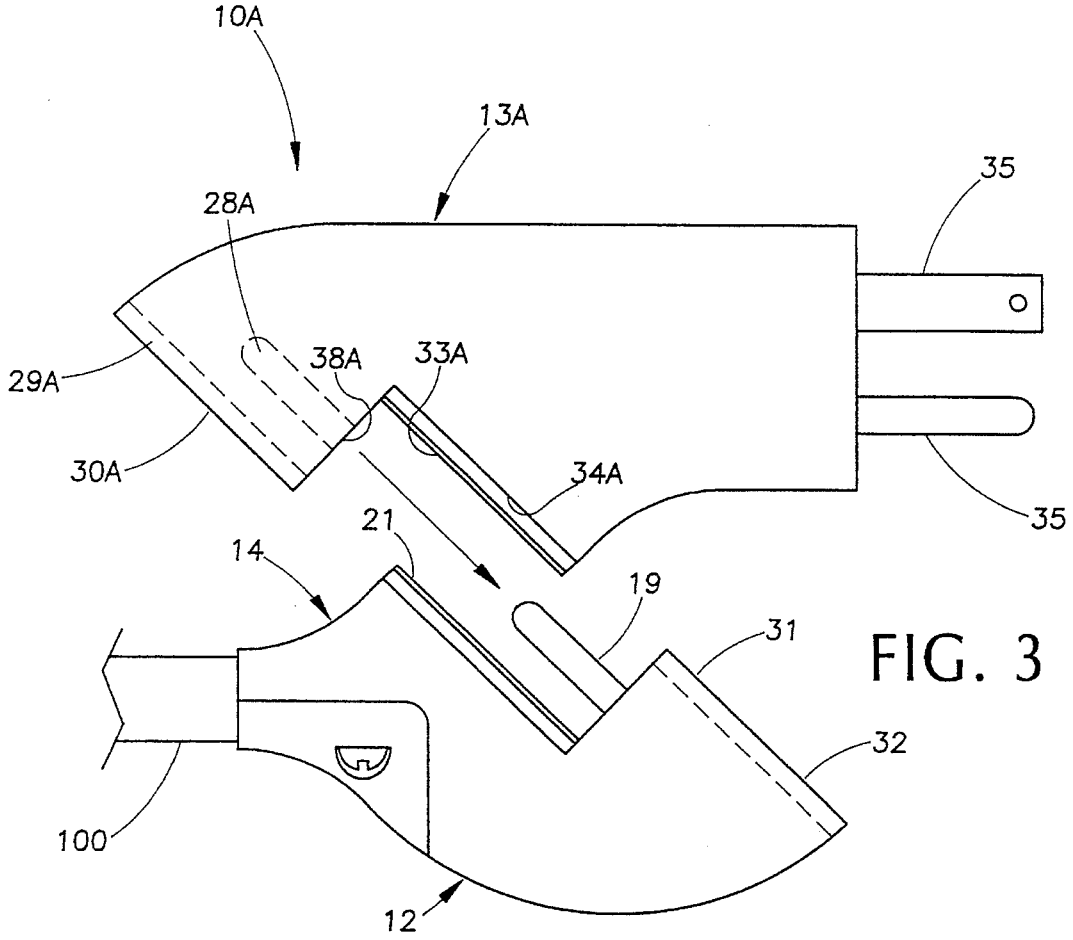
FIG. 3
FIG. 4
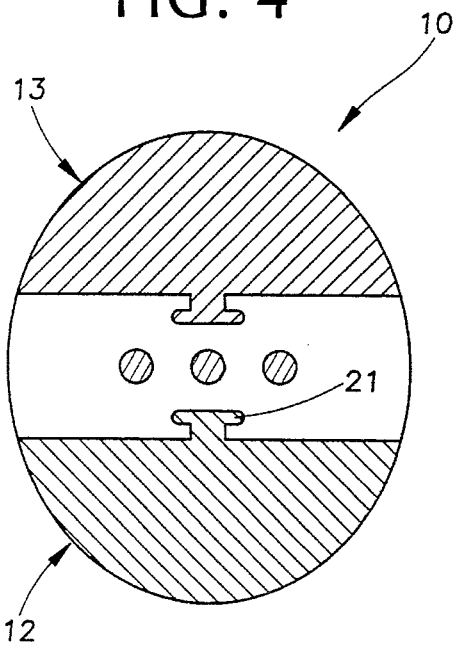
FIG. 5
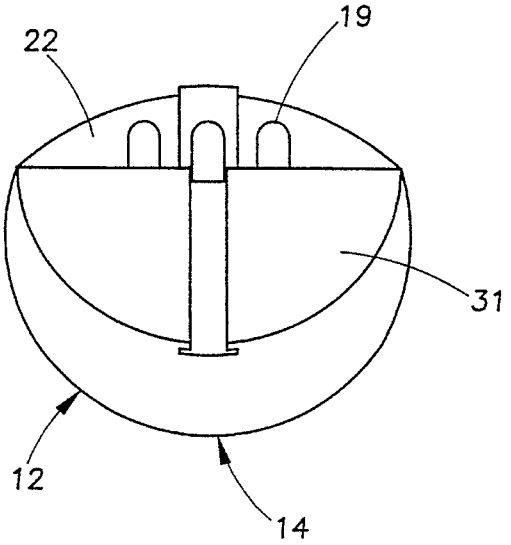

SELF LOCKING MALE AND FEMALE CONNECTORS FOR ELECTRICAL CORDS

BACKGROUND OF THE INVENTION

1. Field of the Invention

This invention relates to electrical cord connectors, in general, and, specifically, to interlocking male and female connectors to reduce the chance of accidental separation of one from the other.

2. Description of the Related Art

Both homeowners and contractors have suffered from the inconvenience of connector separation when they try to get the electrical appliance or tool, plugged into either a wall plug or into one or more extension cords, to reach just another couple of inches only to have the appliance or tool shut off. Many connectors have been modified in several different ways in the past. They have been tied together, looped around each other, wired together and placed in containers that try to force the two connectors to remain together.

U.S. Pat. No. 5,069,634 to M. J. Chiarolanzio on Dec. 3, 1991 for a Snap Lock Extension Cord and Power Tool Connector describes a female connector having a lip on each of two prongs that are releasably inserted into a set of locking slots in the male connector.

U.S. Pat. No. 5,129,836 to N. E. Ursich on Jul. 14, 1992 for a Self-Locking Female Receptor for Electric Cord shows a female receptor into which a male receptor may be releasably locked by balls, located in the female receptor, biased into the holes in the male prongs.

U.S. Pat. No. 5,139,438 to D. P. Gaffney on Aug. 18, 1992 for an Extension Cord Receptacle describes a female connector having legs connected in a "V" with the free ends springingly biased apart to frictionally grasp the prongs of the male connector.

U.S. Pat. No. 5,194,013 to M. Propp on Mar. 16, 1993 for a Lock Plug shows a locking electrical male plug having a key to cause an end on the prongs to expand within a female receptor to reduce accidental removal of the male plug from the female receptor.

U.S. Pat. No. 5,219,304 to C. H. Lin on Jun. 15, 1993 for an Electrical Plug describes a male plug that keeps the prongs and wires leading to them separate from each other by molded plastic channels. The plug is two-piece to assist in connecting the wires to the prongs.

The present invention recognized the problem inherent in many of these devices. Many of them tried to restrain two linearly connected end-pieces from separating when a linear force was applied. They did not address the problem at the root of the problem which was the inadequate initial design of the basic connectors. The present invention redistributes the force vectors usually found in the common connector when its two ends are pulled 180 degrees away from each other and is designed to cause the connectors to become even more secure in their connection as the opposing linear forces are applied. Greater resistance to disconnection must be overcome before the present connectors can be separated. As the electrical cords are pulled apart in opposite directions, the force of separation must be large enough to rotate the connectors and to pull the prongs out of the receptors from a position angular to the plane of the opposing linear cord forces to a position where the prongs and receptors are parallel to the plane of the cord forces. To supplement the resistance of connector separation in the present invention, there are interlocking feet and channels. This results in a male and female connector that will often bind the two connector together even tighter until a force great enough to completely tear the two connectors apart is reached.

SUMMARY OF THE INVENTION

In one aspect of the present invention, an electrical connector apparatus for an electrical cord has a male connector and a female connector. The male connector has a first housing and a plurality of first wiring terminals in the first housing. There is a plurality of prongs electrically connected to the first wiring terminals. The prongs partially extend outside the first housing. There is a T-shaped longitudinal locking foot attached to an outer surface of the first housing. A female connector is removably attached to the male connector.

The female connector has a second housing and a plurality of second wiring terminals in the second housing. There is a plurality of prong receptors electrically connected to the second wiring terminals. The prong receptors are housed inside the second housing. There is a T-shaped longitudinal locking channel attached to an outer surface of the second housing to slidingly and removably receive the T-shaped longitudinal locking foot.

In another aspect of this invention, an electrical connector apparatus for an electrical cord has a male connector. The male connector has a first housing and there is a first wiring chamber in the first housing. There is a first wiring chamber cover removably covering the first wiring chamber and the cover is removably connected to the first housing. A plurality of first wiring terminals are in the first wiring chamber. There is a plurality of prongs electrically connected to the first wiring terminals. The prongs partially extend outside the first housing. A T-shaped longitudinal locking foot is attached to an outer surface of the first housing. There is a female connector removably attached to the male connector;

The female connector has a second housing. There is a second wiring chamber in the second housing. A second wiring chamber cover removably covers the second wiring chamber and is removably connected to the second housing. There is a plurality of second wiring terminals in the second wiring chamber. A plurality of prong receptors, to removably receive the prongs, is electrically connected to the second wiring terminals. The prong receptors are located in the second housing. A T-shaped longitudinal locking channel is attached to an outer surface of the second housing to slidingly and removably receive the T-shaped longitudinal locking foot.

It is an object of this invention to provide a male and female connector for an electrical cord that reduces the possibility of an accidental disconnection of a male connector of this invention from a female connector of this invention.

It is also an object of this invention to provide a female adaptor connector that will allow the user to connect the male connector of this invention to a standard female wall or similar receptacle.

BRIEF DESCRIPTION OF THE DRAWINGS

FIG. 3 is a left side elevational view of another embodiment showing a female connector having a male cross-over thereon to allow the male connector to be used on a standard male receptacle.

FIG. 4 is a cross-sectional view taken along lines 4—4 of FIG. 2.

FIG. 5 is a front elevational view of FIG. 7.

DESCRIPTION OF THE PREFERRED EMBODIMENT

Figure 1:
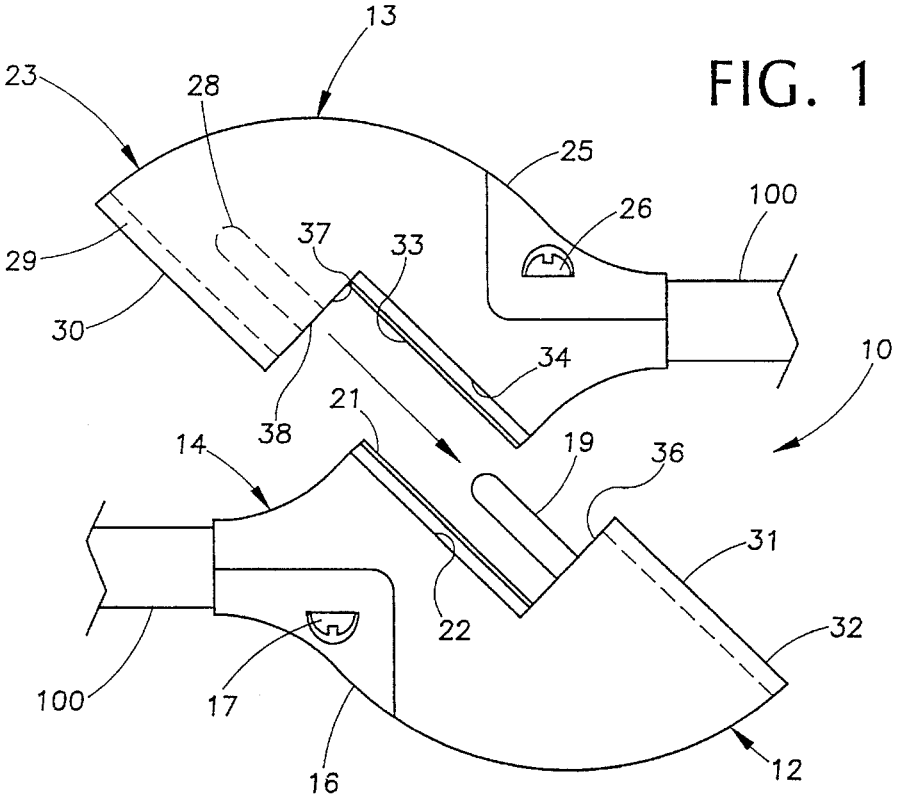
FIG. 1 is a left side elevational view of a male connector and female connector, of the Self Locking Male and Female Connectors for Electrical Cords, about to be coupled as when two extension cords would when mated together or when an appliance is connected to an extension cord.
Figure 2:
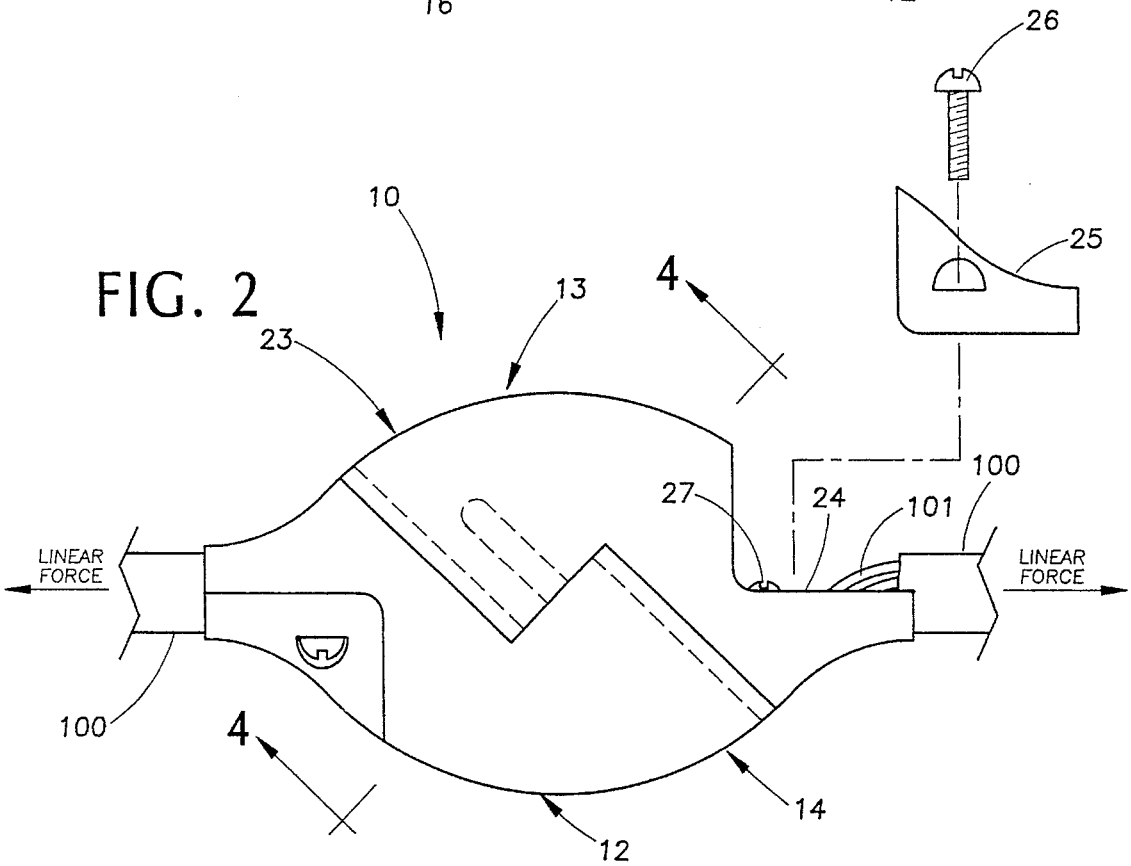
FIG. 2 is a partially exploded left side elevational view similar to FIG. 1 with the connectors mated and showing the wiring access cover removed. The linear force direction arrows show the direction a separation force is most applied in common usage.
Figure 6:
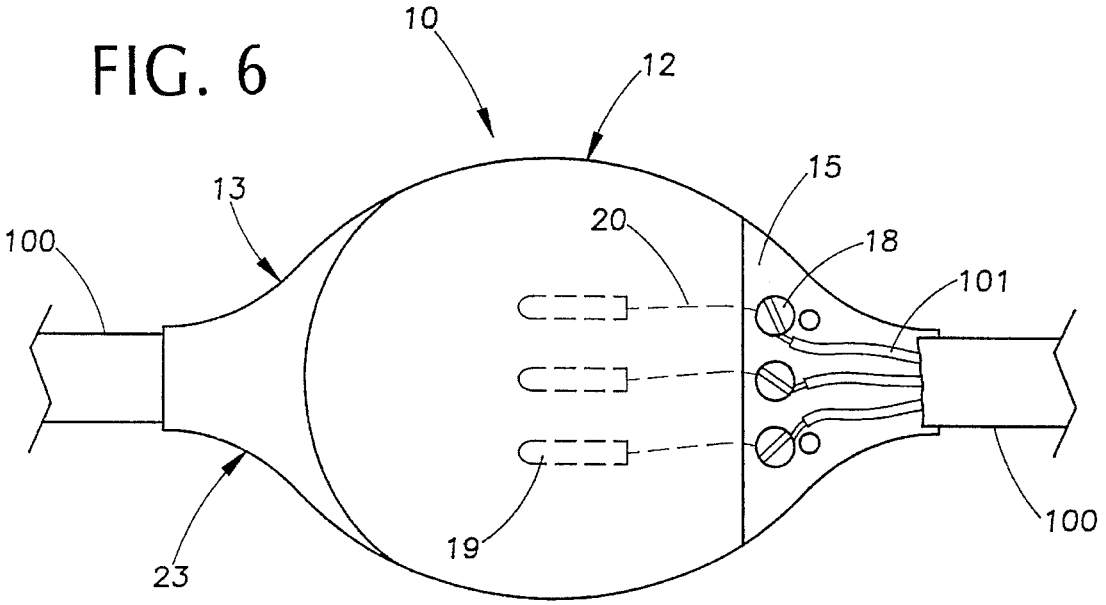
FIG. 6 is a top plan view of FIG. 2 showing the wiring access cover removed and showing the male prongs in hidden lines.
Figure 7:
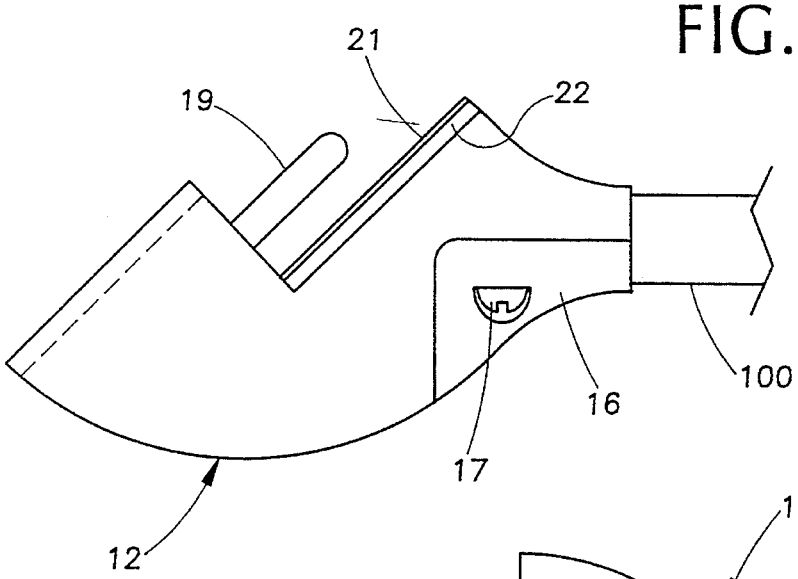
FIG. 7 is a right side elevational view of the male connector shown in FIG. 1.
Figure 8:
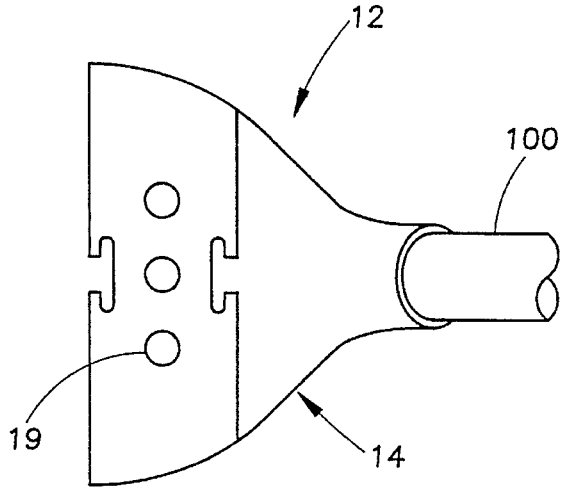
FIG. 8 is a rear elevational view of FIG. 7.

Referring to FIGS. 1 through 8, an electrical connector apparatus 10 for an electrical cord 100 is shown and described that has a male connector 12 and a female connector 13. The housing and covers of the male and female connectors are preferably made of a molded impact resistant, nonconductive, insulative plastic material which may also be resilient. The male connector 12 has a first housing 14. There is a first wiring chamber 15 in the first housing 14 having a first wiring chamber cover 16 that removably covers the first wiring chamber 15 and is removably connected to the first housing 14 preferably by threaded fasteners 17. There is a plurality of first wiring terminals 18 in the first wiring chamber 15 and a plurality of connector prongs 19 electrically connected to the first wiring terminals 18 either by conductor wires 20 or each terminal and associated prong may be an integral piece. The connector prongs 19 partially extend outside the first housing. A first T-shaped longitudinal locking foot 21 is attached to (preferably an integral molded part) a first outer surface 22 of the first housing 12. The female connector 13 is removably attached to the male connector 12.

The female connector 13 has a second housing 23. There is a second wiring chamber 24 in the second housing 23. A second wiring chamber cover 25 removably covers the second wiring chamber 24 and the cover is removably connected to the second housing 23. The cover 25 is preferably attached by threaded fasteners 26. There is a plurality of second wiring terminals 27 in the second wiring chamber. These wiring terminals 27 like those wiring terminals 18 in the first housing 12 allow the wiring 101 from the electrical cord 100 to be secured by threaded fasteners. There is a plurality of prong receptors 28 electrically connected to the second wiring terminals 27. These prong receptors are located in the second housing 13 and removably receive the connector prongs 19. These prong receptors 28 are connected to the wiring terminals 27 by either by conductor wires or each terminal and associated prong receptor 28 may be an integral piece.

The present invention 10 presents a novel way of reducing the chance of the first housing 14 and second housing 23 from separating at an undesired moment. A first T-shaped longitudinal locking channel 29 is attached to (usually a molded integral part) a second outer surface 30 of the second housing 23 to slidingly and removably receive the first T-shaped longitudinal locking foot 21. There is a second T-shaped longitudinal locking channel 31, attached to the third outer surface 32 of the first housing 14, to slidingly and removably receive a second T-shaped longitudinal locking foot 33 on the fourth outer surface 34 of the second housing. The second T-shaped longitudinal locking foot 33 is attached to the fourth outer surface 34 of the second housing 23 to slidingly and removably receive the first T-shaped longitudinal locking channel 21.

The female connector 13A may be modified to allow the electrical connector apparatus 10A to be plugged into a wall or similar socket (not shown). The female connector 13A, in this embodiment 10A, (Like elements have like reference numbers with an "A" added thereto.) is removably attached to the male connector 12 as shown in FIG. 3. This female connector 13A has a second housing 23A similar to the second housing 23 described above but without the wiring chamber or cover. There is a plurality of adaptor prongs 35 in the second housing 23A. The adaptor prongs 35 partially extend outside the second housing 23A in order to be plugged into the wall or other electrical socket. A plurality of prong receptors 28A are electrically connected to the adaptor prongs 35 in the same manner as the receptors 28 are connected to the wiring terminals described above. The prong receptors 28A are located within the second housing 23A. The prongs, receptors and wiring terminals may be made of any suitable conductive material such as copper.

In operation, the feet 21 and 33 and channels 29 and 31 of the male connector 12 and the female connector 13 are aligned and the feet eased into the channels. As the feet are fed into the channels, the connector prongs 19 are aligned with and started into the open end 38 of the receptors 28 until the male abutting surface 36 intimately abuts with the female abutting surface 37. As the two connectors are pulled away from each other, the force tends to secure the two connector even tighter until the force pulls the connectors in a rotative, nonlinear motion. Even then, the connectors will tend to bind until the force on the prongs and receptors are enough to pull them away from each other in almost an 180 degree relationship.

The foregoing descriptions and drawings of the present invention are explanatory and illustrative only, and various changes in shape, sizes and arrangements of parts as well certain details of the illustrated construction may be made within the scope of the appended claims without departing from the true spirit of the invention.

We claim:

1. An electrical connector apparatus for an electrical cord comprising:

(a) a male connector;

(b) said male connector comprising:

a first housing;

a first wiring chamber in the first housing;

a first wiring chamber cover removably covering the first wiring chamber and removably connected to the first housing;

a plurality of first wiring terminals in the first wiring chamber;

a plurality of connector prongs electrically connected to the first wiring terminals;

the connector prongs partially extending outside the first housing; and a first T-shaped longitudinal locking foot attached to a first outer surface of the first housing;

(c) a female connector removably attached to the male connector; and (d) said female connector comprising:

a second housing;

a second wiring chamber in the second housing;

a second wiring chamber cover removably covering the second wiring chamber and removably connected to the second housing;

a plurality of second wiring terminals in the second wiring chamber;

a plurality of prong receptors, to removably receive the connector prongs, electrically connected to the second wiring terminals;

the prong receptors in the second housing; and a first T-shaped longitudinal locking channel attached to a second outer surface of the second housing to slidingly and removably receive the first T-shaped longitudinal locking foot;

(e) a second T-shaped longitudinal locking foot attached to a fourth outer surface of the second housing to slidingly and removably receive the first T-shaped longitudinal locking channel; and (f) a second T-shaped longitudinal locking channel attached to a third outer surface of the first housing to slidingly and removably receive the second T-shaped longitudinal locking foot on the second outer surface of the second housing.

2. An electrical connector apparatus for an electrical cord comprising:

(a) a male connector;

(b) said male connector comprising:

a first housing;

a first wiring chamber in the first housing;

a first wiring chamber cover removably covering the first wiring chamber and removably connected to the first housing;

a plurality of first wiring terminals in the first wiring chamber;

a plurality of connector prongs electrically connected to the first wiring terminals;

the connector prongs partially extending outside the first housing; and a first T-shaped longitudinal locking foot attached to a first outer surface of the first housing;

(c) a female connector removably attached to the male connector; and (d) said female connector comprising:

a second housing;

a plurality of adaptor prongs in the second housing;

the adaptor prongs partially extending outside the second housing;

a plurality of prong receptors, to removably receive the connector prongs, electrically connected to the adaptor prongs;

the prong receptors within the second housing; and a first T-shaped longitudinal locking channel attached to a second outer surface of the second housing to slidingly and removably receive the first T-shaped longitudinal locking foot;

(e) a second T-shaped longitudinal locking foot attached to a fourth outer surface of the second housing to slidingly and removably receive the first T-shaped longitudinal locking channel; and (f) a second T-shaped longitudinal locking channel attached to a third outer surface of the first housing to slidingly and removably receive the second T-shaped longitudinal locking foot on the second outer surface of the second housing.

* * * * *